US010844609B2

(12) United States Patent
Yeary, Jr.

(10) Patent No.: US 10,844,609 B2
(45) Date of Patent: Nov. 24, 2020

(54) BUILDING RAIL SYSTEM

(71) Applicant: Jimmy Keith Yeary, Jr., Arcadia, IN (US)

(72) Inventor: Jimmy Keith Yeary, Jr., Arcadia, IN (US)

( * ) Notice: Subject to any disclaimer, the term of this patent is extended or adjusted under 35 U.S.C. 154(b) by 0 days.

(21) Appl. No.: 15/494,768

(22) Filed: Apr. 24, 2017

(65) Prior Publication Data

US 2017/0306620 A1 Oct. 26, 2017

Related U.S. Application Data

(60) Provisional application No. 62/326,235, filed on Apr. 22, 2016.

(51) Int. Cl.

| | |
|---|---|
| ***E04F 13/08*** | (2006.01) |
| ***E04B 1/70*** | (2006.01) |
| *E04F 13/00* | (2006.01) |

(52) U.S. Cl.

CPC ..... *E04F 13/0875* (2013.01); *E04F 13/0803* (2013.01); *E04B 1/70* (2013.01); *E04F 13/007* (2013.01)

(58) Field of Classification Search

CPC . E04B 2/44; E04B 1/7038; E04B 2/52; E04B 2/60; E04B 1/70; E04B 2002/028; E04B 9/02; E04B 9/0421; E04B 1/0023; E04B 9/001; E04B 9/005; E04B 9/04; E04B 9/0435; E04B 9/0457; E04B 9/06; E04B 9/064; E04B 9/12; E04B 9/122; E04B 9/127; E04B 9/14; E04B 9/16; E04B 9/18; E04B 2/28; E04B 2/30; E04B 2/42; E04B 2/58; E04B 2/62; E04B 2/76; E04B 2/762; E04B 2/767; E04B 2/78; E04B 2002/7461; E04F 17/00; E04F 17/064; E04F 2001/00; E04F 13/0816; E04F 13/0801; E04F 13/0807; E04F 13/12; E04F 13/0853; E04F 13/0803; E04F 13/0875; E04F 13/007; E04F 2/707

USPC ..... 52/302.1, 302.3, 302.6, 302.7, 378, 379, 52/383, 407.1, 407.5, 478, 479, 481.1, 52/483.1, 506.01, 506.03, 506.04, 506.05, 52/506.06, 562, 565, 568, 698, 703, 704, 52/741.3, 408, 506.6, 58, 504.2, 404.3, 52/404.5, 407.4, 506.5

See application file for complete search history.

(56) References Cited

U.S. PATENT DOCUMENTS 2,221,001 A * 11/1940 Lucius ..... E04B 9/02 165/57
2,559,868 A * 7/1951 Gay ..... E04B 1/0023 165/45
2,559,869 A * 7/1951 Gay ..... E04B 1/0023 126/632
2,559,871 A * 7/1951 Gay ..... E04B 1/0023 126/630
3,160,248 A * 12/1964 Galajikian ..... E04B 2/60 52/279

(Continued)

*Primary Examiner* — Kyle J. Walraed-Sullivan
(74) *Attorney, Agent, or Firm* — Indiana University Maurer School of Law IP Legal Clinic

(57) ABSTRACT

A building rail system. The system includes large and small building rails capable of forming flush connections at varied angles. The flush connection of the rails eliminates an extra layer of space that would otherwise exist if the rails had to be offset to form a connection.

8 Claims, 15 Drawing Sheets

(56) References Cited

U.S. PATENT DOCUMENTS 3,233,373 A * 2/1966 Behlen ..... E04B 7/00 52/22
3,327,438 A * 6/1967 Cooper ..... E04B 2/766 52/204.591
3,353,316 A * 11/1967 Berg ..... E04D 3/38 52/302.3
3,359,697 A * 12/1967 Smith ..... E04B 9/02 52/28
3,503,166 A * 3/1970 Lipper ..... E04B 2/78 52/126.6
3,534,516 A * 10/1970 Cooper ..... E04B 2/76 52/242
3,628,299 A * 12/1971 Nakazawa ..... E04B 1/4107 52/506.06
3,685,235 A * 8/1972 Lang ..... A47H 1/04 454/292
3,774,366 A * 11/1973 Baker ..... E04B 9/064 52/66
3,998,016 A * 12/1976 Ting ..... E04B 1/98 52/323
4,073,108 A * 2/1978 Williams ..... E04B 2/825 52/238.1
4,185,422 A * 1/1980 Radek ..... E04B 2/7425 52/239
5,007,222 A * 4/1991 Raymond ..... E04B 1/0023 52/220.1
5,065,557 A * 11/1991 Laplante ..... E04B 2/96 52/235
5,634,300 A * 6/1997 Huebner ..... E04B 2/7407 52/281
5,946,870 A * 9/1999 Bifano ..... E04B 1/765 52/254
6,134,847 A * 10/2000 Bifano ..... E04B 1/765 52/101
6,349,519 B1 * 2/2002 Beller ..... E04B 1/70 52/410
6,546,684 B2 * 4/2003 Waalkes ..... E04B 2/7433 52/239
6,557,310 B2 * 5/2003 Marshall ..... A47B 83/001 52/220.1
6,745,527 B1 * 6/2004 Sherman ..... E04B 2/96 52/235
6,748,709 B1 * 6/2004 Sherman ..... E04B 2/96 52/235
6,748,710 B2 * 6/2004 Gresham ..... E04B 2/7425 52/242
6,807,776 B2 * 10/2004 Girdwood ..... A47B 83/001 160/130
6,910,306 B2 * 6/2005 Waalkes ..... A47B 21/06 52/220.7
6,951,087 B2 * 10/2005 Weurman ..... E04B 2/7457 52/481.1
7,617,638 B1 * 11/2009 Slama ..... E04B 2/707 52/198
8,910,441 B1 * 12/2014 Hunter ..... E04F 13/0805 52/474
8,919,068 B2 * 12/2014 Wright ..... E04F 15/02183 52/302.1
9,115,489 B2 * 8/2015 Bourdon ..... E04B 2/90
9,441,371 B1 * 9/2016 Harkins ..... E04C 3/02
9,755,201 B2 * 9/2017 Frazier ..... H01M 2/1077
9,856,642 B2 * 1/2018 Ukrainetz ..... E04B 2/60
9,856,655 B2 * 1/2018 Knight ..... E04F 13/0862
9,879,400 B1 * 1/2018 Walker ..... E02D 31/025
2001/0054263 A1 * 12/2001 Coulton ..... B32B 3/28 52/199
2002/0029535 A1 * 3/2002 Loper ..... E04F 17/00 52/302.1
2002/0108333 A1 * 8/2002 Clayton ..... E04B 1/70 52/302.1
2003/0177708 A1 * 9/2003 Gatherum ..... E02D 31/02 52/58
2004/0045235 A1 * 3/2004 Ley ..... E04B 2/965 52/235
2004/0226225 A1 * 11/2004 Olk ..... E04D 13/02 52/58
2004/0255535 A1 * 12/2004 Herren ..... E04B 1/08 52/348
2005/0060950 A1 * 3/2005 Hauschildt ..... E04F 13/0814 52/235
2006/0000670 A1 * 1/2006 Dodd ..... E04B 2/7409 181/285
2006/0011802 A1 * 1/2006 Di Cesare ..... B28B 7/0041 249/158
2006/0026911 A1 * 2/2006 Sutton ..... E04B 2/7457 52/169.5
2006/0053727 A1 * 3/2006 Bland ..... E04C 3/28 52/648.1
2006/0174573 A1 * 8/2006 Melencion ..... E04B 1/72 52/506.01
2006/0179744 A1 * 8/2006 Lynch ..... E04F 13/007 52/235
2006/0277854 A1 * 12/2006 Egan ..... E04B 1/70 52/302.3
2007/0113499 A1 * 5/2007 Williams ..... E04B 1/7069 52/302.1
2008/0104918 A1 * 5/2008 Gleeson ..... E04B 1/74 52/489.1
2008/0163569 A1 * 7/2008 Woodard ..... E04B 1/34326 52/169.9
2008/0163582 A1 * 7/2008 Trevethick ..... E04B 1/70 52/716.2
2008/0196332 A1 * 8/2008 Surowiecki ..... E04B 2/60 52/204.2
2010/0037549 A1 * 2/2010 Lynch ..... E04F 13/0889 52/506.08
2010/0146893 A1 * 6/2010 Dickinson ..... E04B 1/70 52/302.3
2010/0229484 A1 * 9/2010 Carolan ..... E04C 2/292 52/302.1
2010/0251647 A1 * 10/2010 Enns ..... E04F 13/081 52/302.1
2010/0287861 A1 * 11/2010 Goldberg ..... E04B 1/70 52/302.1
2010/0287862 A1 * 11/2010 Goldberg ..... E04B 1/70 52/302.1
2011/0197530 A1 * 8/2011 Bahnmiller ..... B32B 5/14 52/309.4
2011/0258944 A1 * 10/2011 Radoane ..... E04B 2/58 52/62
2012/0137610 A1 * 6/2012 Knight ..... E04B 2/58 52/309.1
2012/0174503 A1 * 7/2012 Milostic ..... E04B 2/7409 52/173.1
2012/0216471 A1 * 8/2012 Manser ..... E04B 1/4178 52/302.1
2012/0255249 A1 * 10/2012 Singh ..... E04F 19/065 52/302.1
2012/0272590 A1 * 11/2012 Goldberg ..... E04B 1/70 52/169.14
2012/0272598 A1 * 11/2012 Wilkie ..... E04F 13/0835 52/302.3
2012/0285116 A1 * 11/2012 Walker ..... E04C 2/34 52/741.4
2012/0297725 A1 * 11/2012 Anastasi ..... E04F 13/0807 52/705
2012/0317909 A1 * 12/2012 MacKenzie ..... E04F 13/0803 52/288.1
2013/0074432 A1 * 3/2013 Ciuperca ..... E04B 1/21 52/309.4
2013/0125487 A1 * 5/2013 Power ..... E04B 1/70 52/302.3
2013/0174506 A1 * 7/2013 Bombino ..... E04B 1/7612 52/309.13
2013/0205695 A1 * 8/2013 Newell ..... E04F 13/08 52/235
2013/0205698 A1 * 8/2013 Todd ..... E04F 13/0805 52/302.1

(56) References Cited

U.S. PATENT DOCUMENTS

2013/0232902 A1* 9/2013 Mayer ..... E04B 2/7457 52/483.1
2013/0276392 A1* 10/2013 Johnson ..... E04F 13/04 52/302.1
2013/0291465 A1* 11/2013 Resso ..... E04F 13/007 52/302.1
2013/0312347 A1* 11/2013 Milostic ..... E04B 1/70 52/404.1
2014/0026510 A1* 1/2014 Kubassek ..... E04B 1/40 52/512
2014/0090323 A1* 4/2014 Glancy ..... E04B 2/562 52/404.2
2014/0124291 A1* 5/2014 Dugan ..... E04B 1/84 181/290
2014/0224459 A1* 8/2014 Sasaki ..... E04F 13/12 165/169
2015/0013258 A1* 1/2015 Sawatzky ..... E04B 2/46 52/309.1
2015/0020468 A1* 1/2015 Wickstrom ..... E04F 13/0816 52/274
2015/0052840 A1* 2/2015 Beaty ..... E06B 1/34 52/483.1
2015/0128512 A1* 5/2015 Troyer ..... E02D 17/00 52/169.5
2015/0128518 A1* 5/2015 Knight ..... E04F 13/0864 52/404.1
2015/0143763 A1* 5/2015 Gosling ..... E04B 2/7448 52/220.7
2015/0275509 A1* 10/2015 Ciuperca ..... E04B 1/80 52/745.09
2015/0359329 A1* 12/2015 Frazier ..... A47B 45/00 211/200
2015/0361653 A1* 12/2015 Grant ..... E04B 1/625 52/302.1
2016/0024788 A1* 1/2016 Grisolia ..... A47K 3/008 52/302.1
2016/0040425 A1* 2/2016 Farahmandpour ..... E04F 13/00 52/235
2016/0053494 A1* 2/2016 White ..... E04F 13/0805 52/698
2016/0069067 A1* 3/2016 Ciuperca ..... E04B 1/625 52/309.8
2016/0145875 A1* 5/2016 Scully ..... E04F 13/0807 52/698
2016/0177565 A1* 6/2016 Aykas ..... E05D 15/0652 52/64
2016/0201314 A1* 7/2016 Hatzinikolas ..... F16M 13/02 248/220.22
2017/0037619 A1* 2/2017 Dietzen ..... E04C 3/11
2017/0159293 A1* 6/2017 Haley ..... E04C 3/28
2017/0167134 A1* 6/2017 Mayer ..... E04B 1/7612
2017/0191265 A1* 7/2017 Edwards ..... E02D 27/00
2017/0204615 A1* 7/2017 Gulnick ..... E04F 13/0803
2017/0226734 A1* 8/2017 Miks ..... E04B 2/562
2017/0254069 A1* 9/2017 Burke ..... E04B 1/7046
2017/0254091 A1* 9/2017 Friel ..... E04F 13/06

* cited by examiner

BUILDING RAIL SYSTEM

CROSS REFERENCE TO RELATED APPLICATIONS

The present application claims the benefit of U.S. Provisional Application No. 62/326,235, filed Apr. 22, 2016, titled "Building Rail System," to Jimmy K. Yeary, Jr., the entire disclosure of which is hereby incorporated by reference.

FIELD OF THE DISCLOSURE

Building rail system are used to support siding on a building.

BACKGROUND AND SUMMARY OF THE DISCLOSURE

A recent trend in the construction of energy-efficient buildings is the use of continuous insulation. The use of continuous insulation has become a popular practice in Europe, due in large part to Europe's high energy standards. As energy codes in the United States are updated with higher building efficiency requirements, there is likely to be an increased utilization of continuous insulation in newly built and updated buildings within the United States, as well.

Building rail systems are currently used in some continuous insulation systems. A common function of a building rail system is the hanging of exterior facade panels.

According to the present disclosure, a building system is provided including a plurality of structural support members, insulation coupled to the plural of structural support members, and a building rail system supported by the plurality of structural support members. The building rail system includes a plurality of vertical rails having an interior surface facing inwardly toward a building interior and an exterior surface and a plurality of transverse rails coupled to the vertical rails. The plurality of transverse rails has an interior surface and an exterior surface. The exterior surfaces of the vertical rails and the exterior surfaces of the transverse rails are coplanar. The building system further includes siding supported by the transverse rails.

According to another aspect of the present disclosure, a building system is provided that includes a plurality of structural support members, insulation coupled to the plurality of structural support members, and a building rail system supported by the plurality of structural support members. The building rail system includes a plurality of aluminum vertical rails. The building system further includes siding supported by the aluminum vertical rails.

According to another aspect of the present disclosure, a building system is provided that includes a plurality of structural support members and a building wall layer including at least one of insulation, sheathing, and waterproofing. The building layer is coupled to the plurality of structural support members. The building system further includes a building rail system supported by the plurality of structural support members. The building rail system includes a plurality rails positioned adjacent to the building wall layer. The building system further includes siding supported by the rails, the siding and the building wall layer cooperating to define an air flow path therebetween, at least 60 percent of the air flow path is blocked by the plurality of rails.

According to another aspect of the present disclosure, a building system is provided including a plurality of structural support members and a building wall layer including at least one of insulation, sheathing, and waterproofing. The building layer is coupled to the plurality of structural support members. The building system further includes a building rail system supported by the plurality of structural support members. The building rail system includes a plurality rails positioned adjacent to the building wall layer. The building system further includes siding supported by the rails. The plurality of rails define a plurality of traverse channels positioned to direct water between the building wall layer and siding in a transverse direction and a plurality of vertical channels positioned to direct water between the building wall layer and the siding in a vertical direction.

BRIEF DESCRIPTION OF THE DRAWINGS

The aforementioned aspects and many of the intended features of this disclosure will grow to be appreciated at a greater level once references to the following accompanying illustrations are expounded upon.

Figure 1:
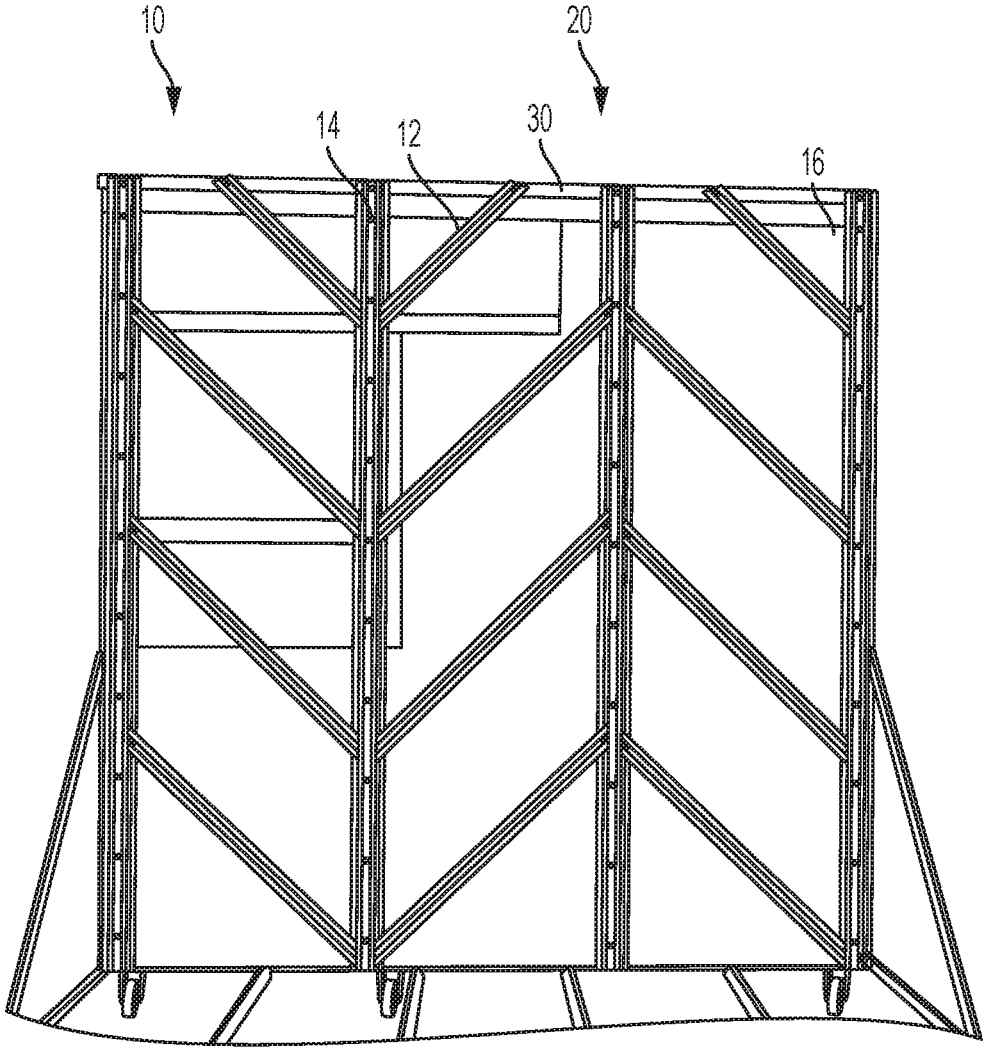
FIG. 1 is a side elevation view of an embodiment of a building rail system showing the system including large vertical rails and small transverse rails in between the vertical rails.

Equivalent reference components point to corresponding parts throughout the several views. Unless otherwise indicated, the components shown in the drawings are proportional to each other. Wherein, the illustrations depicted are manifestations of the disclosure, and such illustrations shall in no way be interpreted as limiting the scope of the disclosure.

For the purposes of promoting an understanding of the principals of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. It will be understood that no limitation of the scope of the disclosure is thereby intended. The disclosure includes any alterations and further modifications in the illustrative devices and described methods and further applications of the principles of the disclosure which would normally occur to one skilled in the art to which the disclosure relates.

DETAILED DESCRIPTION OF THE DRAWINGS

Figure 2:
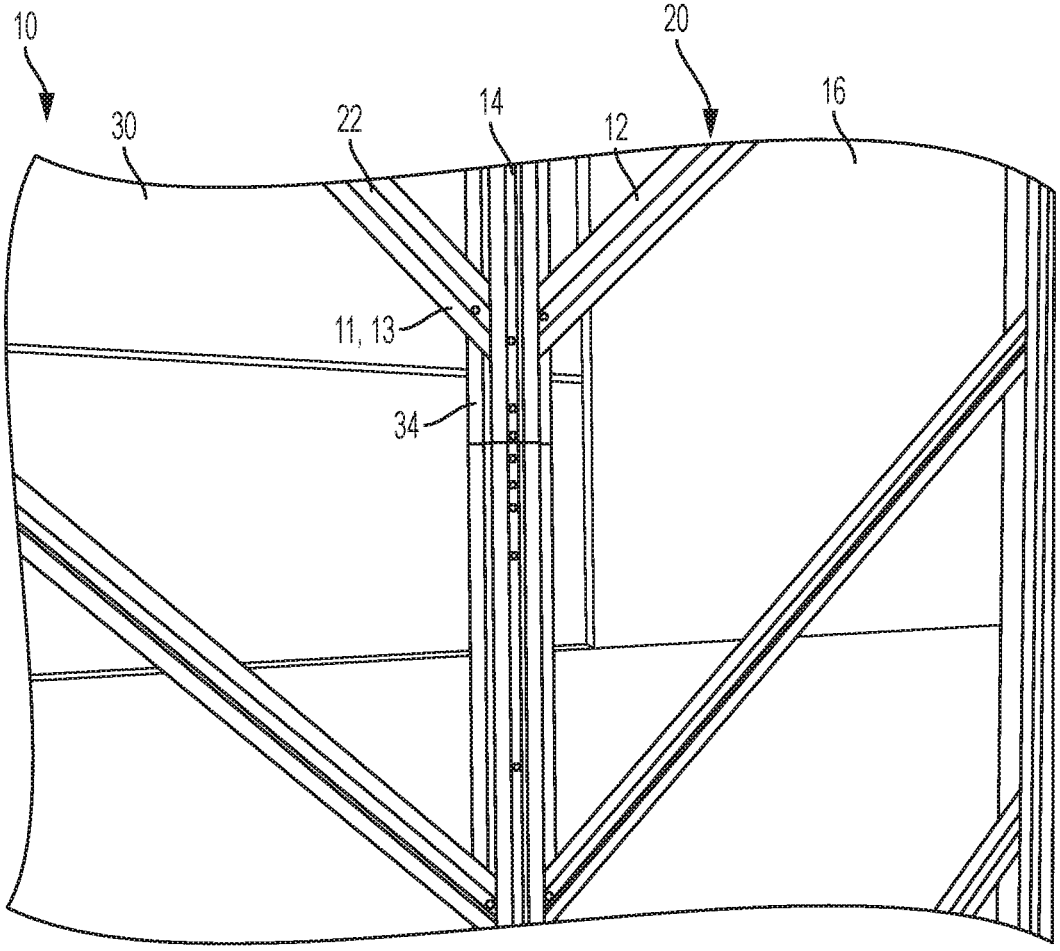
FIG. 2 is a perspective view of a portion of the system of FIG. 1 showing small rails nesting with vertical rails.
Figure 6:
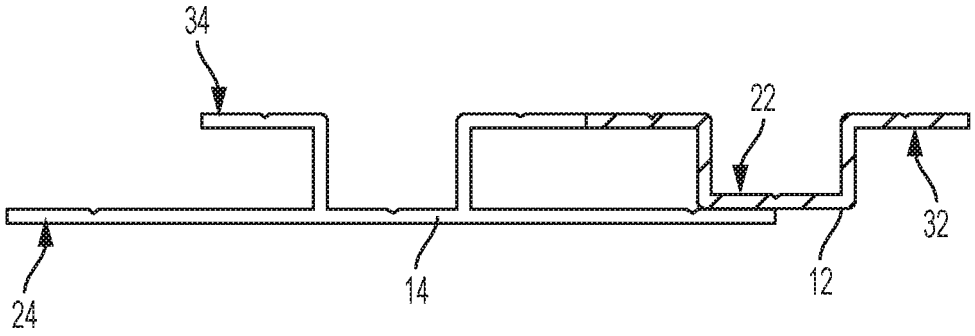
FIG. 6 is a cross sectional view of the small rail (shaded) nested with the large rail.
Figure 8:
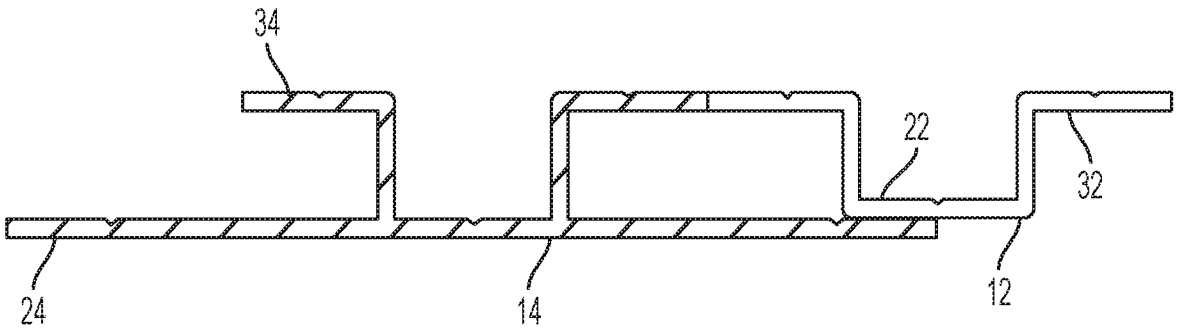
FIG. 8 is a cross sectional view of the large rail (shaded) nested with the small rail.

Referring to FIGS. 1 and 2, a section of a wall 10 is shown, displaying an embodiment of a rail system 20 comprising large vertical rails 14 and small transverse rails 12. In this embodiment, rails 12, 14 are comprised of extruded aluminum. In some embodiments, only vertical rails 14 are used, with no small rails 12 placed in between. In the embodiment shown in FIGS. 1 and 2, small rails 12 are angled at 45 degree and nest with vertical rails 14 so that a flush connection is formed, as shown in FIGS. 6 and 8. In this depiction, at a flush connection point between a small rail 12 and large rail 14, a center section 22 of small rail 12 rests on a bottom flange 24 of large rail 14, and top flanges 32 of small rail 12 align with top flanges 34 of large rail 14. The flush connection between vertical rails 14 and small rails 12 eliminates an extra layer of space that would otherwise exist if the rails had to be offset to form a connection.

Figure 7:
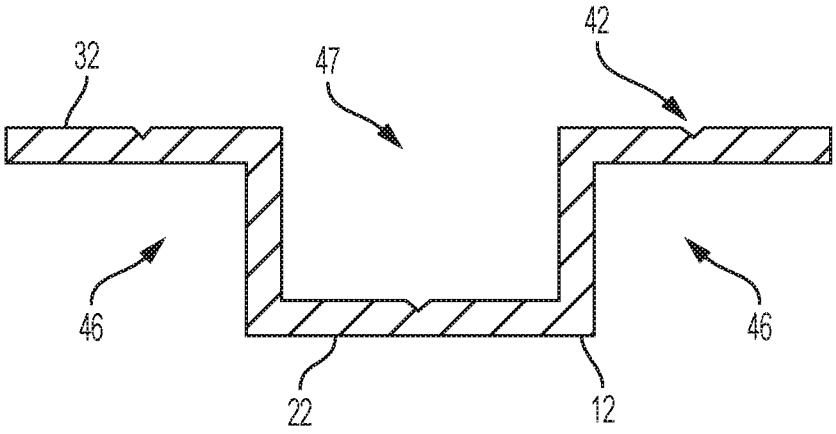
FIG. 7 is a cross sectional view of a single small rail of FIG. 6.
Figure 9:
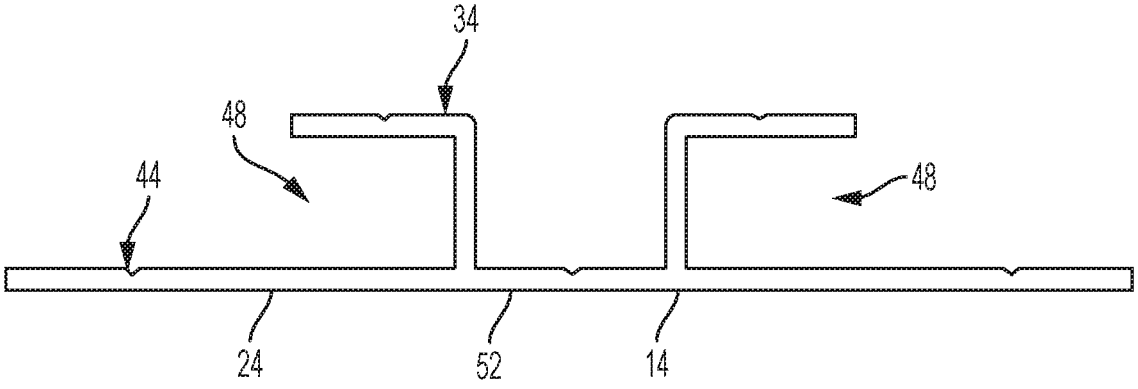
FIG. 9 is a cross sectional view of a single large rail of FIG. 8.

In some embodiments, rails 12, 14 are fastened together with stainless steel fasteners 11 and thermal washers 13 at grooves 42, 44 (see FIGS. 7, 9). In some embodiments, when fasteners 11 and thermal washers 13 secure the connection between larger rails 14 and small rails 12, they fasten center section 22 of small rail 12 to lower flange 32 of large rail 14 (see FIG. 2). However, this is not the only means of fastening vertical rails 14 and small rails 12 to one another. Small rail 12 and large rail 14 function to hold exterior facade panels 40 (represented by dashed rectangle in FIG. 3), which may be coupled to a horizontal member 15 coupled to small rail 12 and large rail 14.

Small rail 12 and large rail 14 may be coupled to a plural of structural support members, such as interior metal studs 17, as can be seen in more detail in FIGS. 10 and 12-16. In some embodiments, this connection will be made with fasteners 11 and thermal washers 13, and a region 30 will exist between large rail 14 and metal stud 17. Region 30 is sized to accommodate building wall layers such as, but not limited to, insulation 16 and waterproofing 21 (see FIG. 10). Region 30 may allow for large areas of wall 10 to be insulated with an uninterrupted (other than fasteners 11) body or matrix of insulation 16. With large areas of wall 10 insulated with a continuous body or matrix of insulation 16 without interruption or sectioning by intermediate structural bodies, such as metal studs 17 or wooden studs (not shown), wall 10 may function to further restrict heat transfer that may otherwise occur through the one or more intermediate structural bodies. Intermediate structural bodies which facilitate high transfer of heat to and from opposing sides of wall 10 may be referred to as "thermal bridges." According to the preferred embodiment, insulation has an R-value of at least 10. According to alternative embodiments, other R-value may be provided, such as 4, 6, 8, 12, 13, 14, 15, 16, 18, 20, etc.

Figure 3:
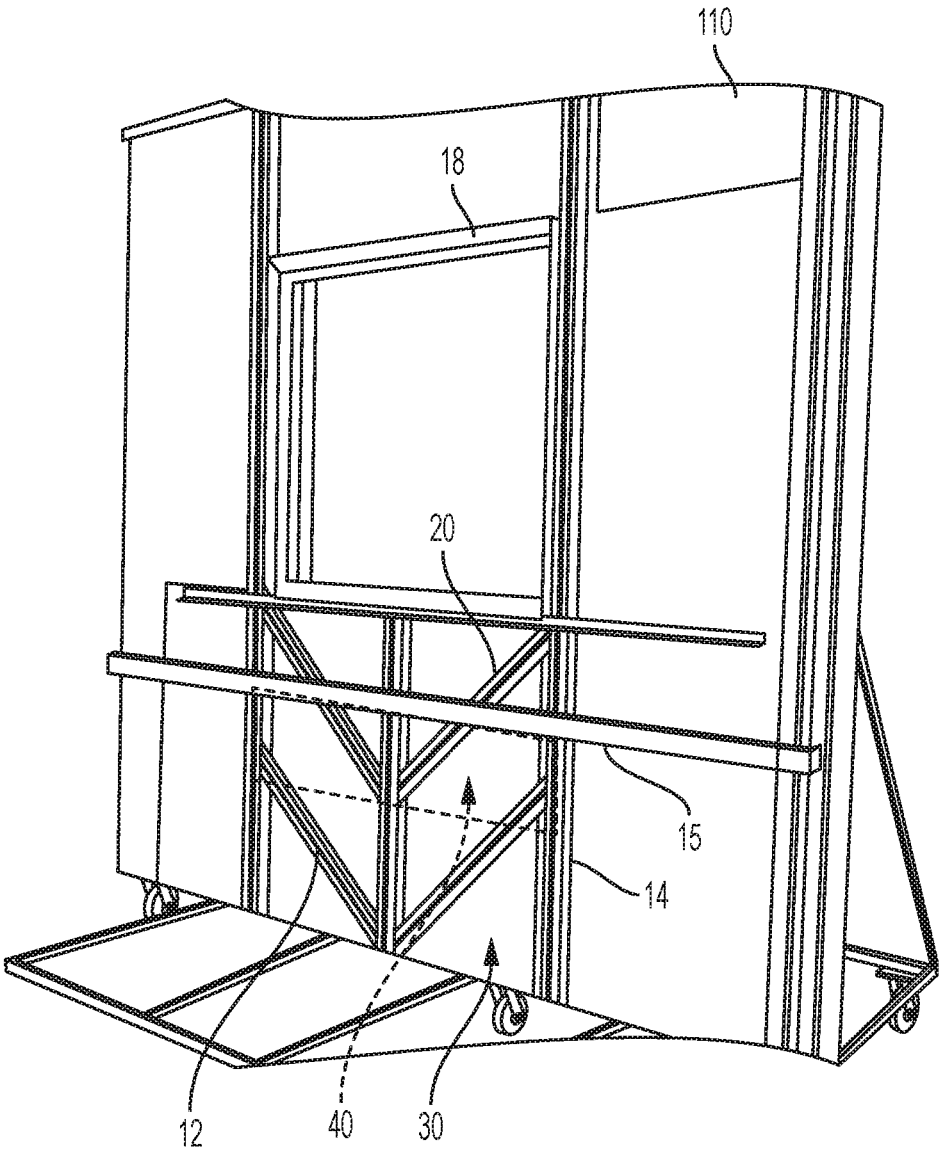
FIG. 3 is a perspective view of an embodiment of a building rail system in use with a window showing the large and small rails and horizontal facade supporting members.

Referring to FIG. 3, another wall 110 is shown. In this embodiment, a configuration of vertical rails 14 and angled small rails 12 similar to the configuration in FIGS. 1 and 2 is shown in use with a window 18. Additionally, in this embodiment, horizontal member 15 is shown, which is an intermediate member between rail system 20 and exterior facade panels 40 (represented by dashed rectangle in FIG. 3) that are supported by rail system 20. As depicted, window frame 18 is placed between vertical rails 14, and above sections of angled small rails 12. In other words, window frame 18 may occupy an area that would otherwise comprise additional angled small rails 12, bit for window frame 18.

Figure 4:
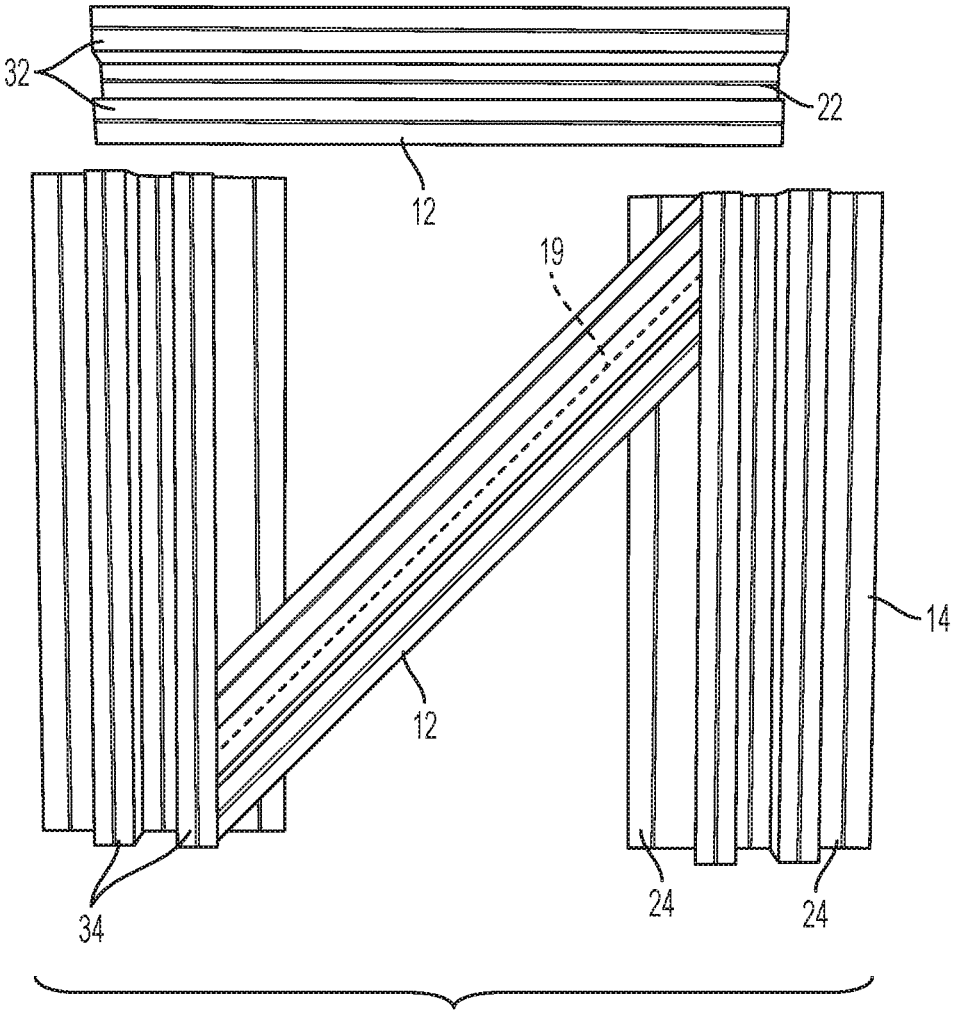
FIG. 4 is a top plan view showing a small rail at a diagonal angle, nested with two large vertical rails, and a small rail positioned horizontally above this system.
Figure 5:
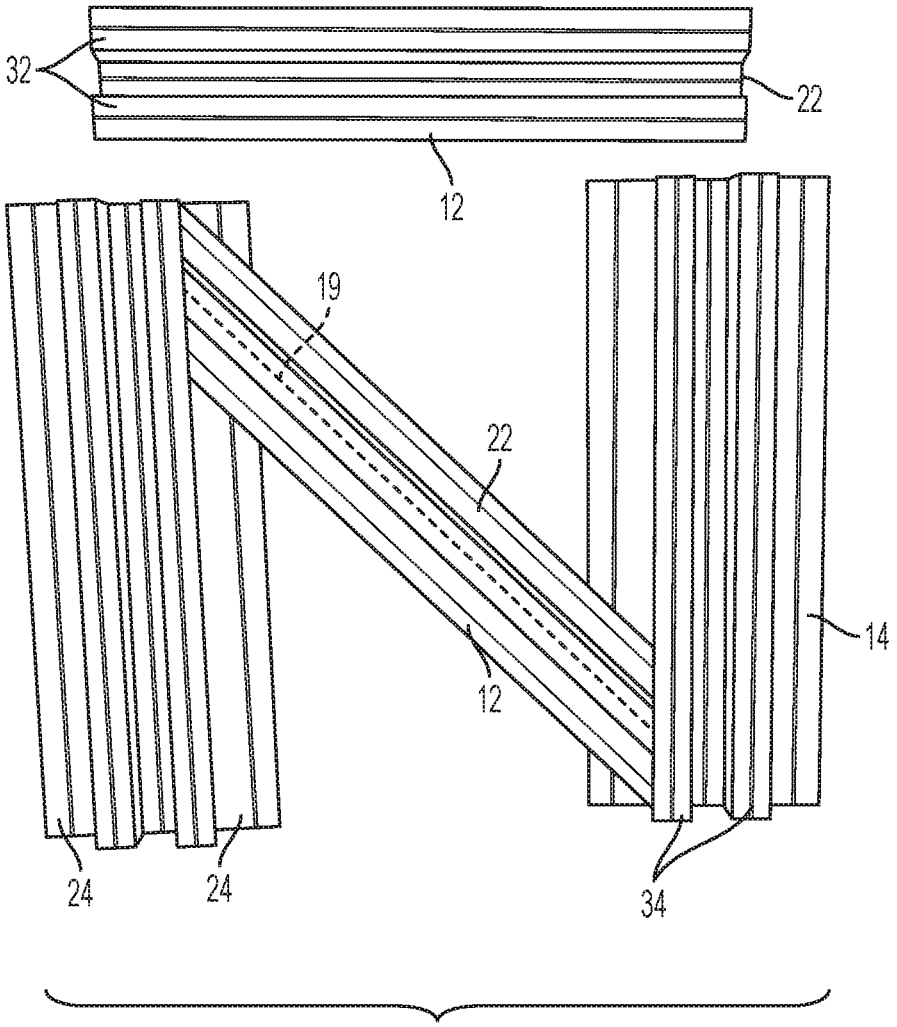
FIG. 5 is a top plan view similar to FIG. 4 showing the small diagonal rail flipped so that that bottom of the rail (as shown in FIG. 4 is) is facing upward.

Referring to FIGS. 4 and 5, sections of individual rails 12, 14, according to one embodiment, are shown. Vertical rails 14 are displayed vertically in a way in which they may be configured in a rail system 20. In this embodiment, small rail 12 is placed at a 45 degree angle between two vertical rails 14, and small rail 12 is nested flush with vertical rails 14 so that flanges 32 of small rail 12 (FIG. 4) or center section 22 of small rail 12 (FIG. 5) align at an equal height to top flanges 34 of vertical rails 14. FIGS. 4 and 5 show how, in some embodiments, small rail 12 may be placed with its center section 22 facing either upward or downward. In FIG. 5, small rail 12 has been rotated 180 degrees along its longitudinal axis 19 in comparison to its position in FIG. 4.

Figure 11:
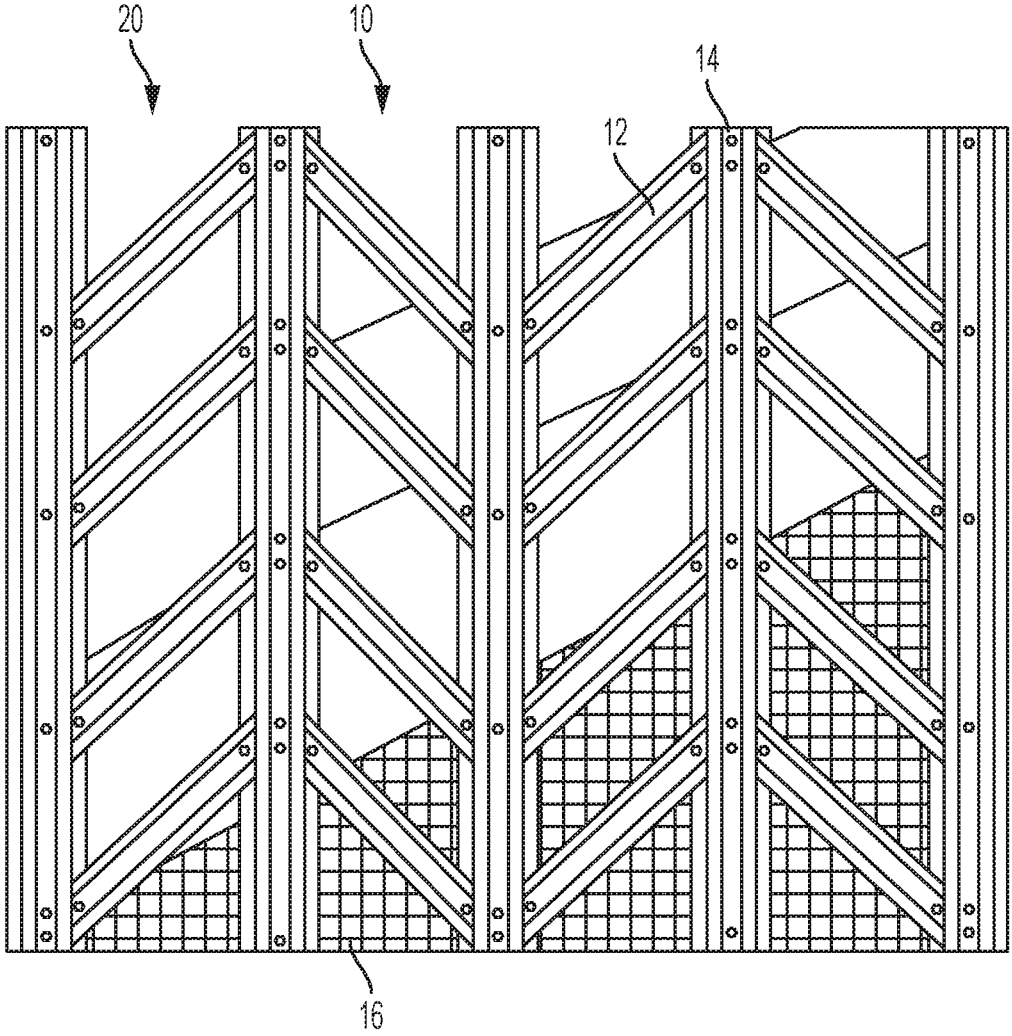
FIG. 11 is a side view of a system comprising the large vertical rails and the small transverse rails showing insulation, a waterproofing layer, and sheathing (portion of each cutaway) positioned interior of the rails.

Referring to FIGS. 6-9, cross sectional drawings of vertical rails 14 and small rails 12 are provided. In FIGS. 6 and 7, small rail 12 is shaded. In FIGS. 8 and 9, large rail 14 is shaded. The components in FIGS. 7 and 9 are proportional with the labeled measurements being merely representative of one configuration. FIGS. 6 and 8 illustrate the flush relationship of small rail 12 nested next to large rail 14. Although large rail 14 and small rail 12 are shown parallel in FIGS. 6 and 8, in some embodiments they may not be parallel and may be connected at an angle with small rail 12 cut to nest evenly against large rail 14 with top flanges 24 of small rails 12 at an equal height to top flanges 34 of vertical rails 14. For example, as shown in FIG. 11, in one embodiment small rail 12 may be angled at 45 degrees and connected to vertical large rail 14 by fasteners 11 and thermal washers 13.

Figure 10:
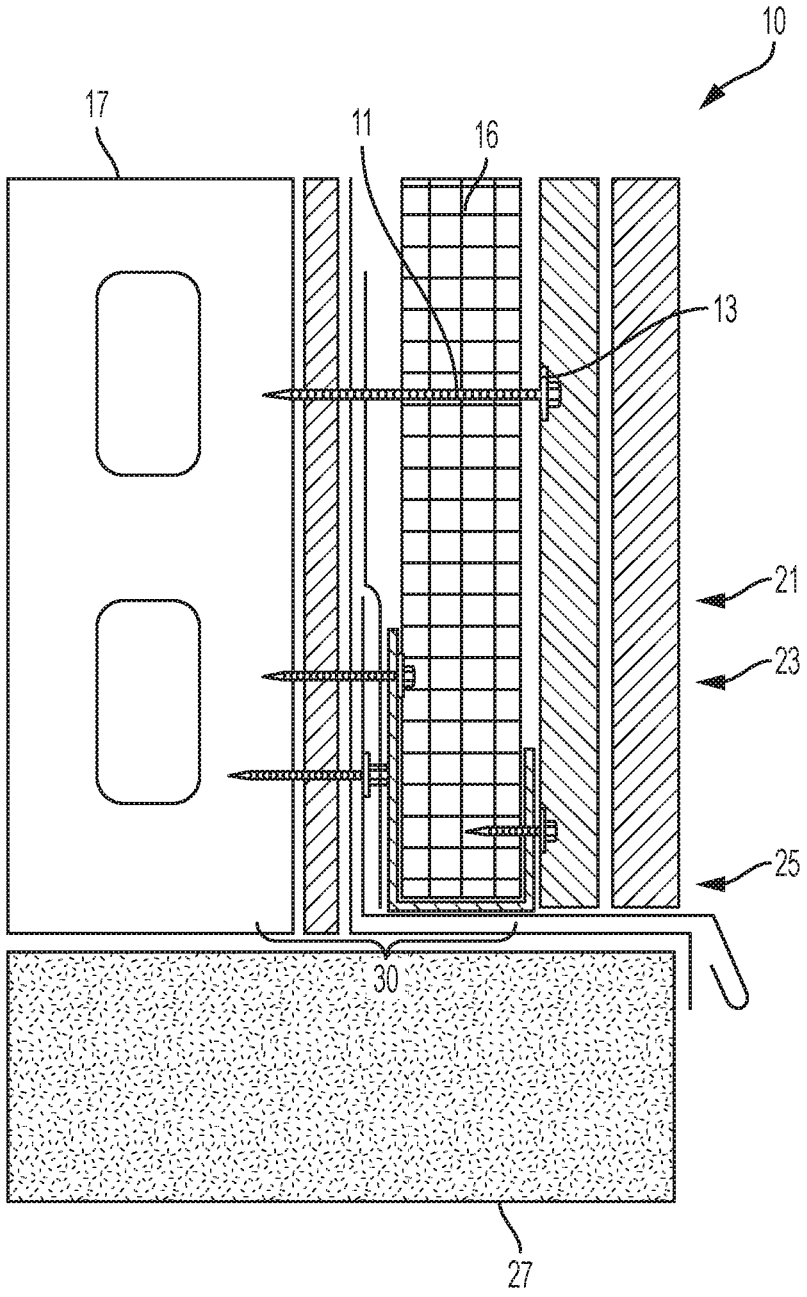
FIG. 10 is a cross sectional of a large rail with a typical drip edge detail.

FIGS. 10 and 12-16 are cross sectional views of a building rail system 20. In FIG. 10, wall 10 is shown with one embodiment of large rail 14 within it. In one embodiment, rail 14 is fastened to metal stud 17 with fasteners 11 and thermal washers 13 with layer of insulation 16, layer of waterproofing 21, and an intermediate layer 23 of a material such as densglass or plywood between rail 14 and metal stud 17. In some embodiments, large rail 14 may end at a drip edge 25 with a concrete slab 27 below drip edge 25.

Figure 12:
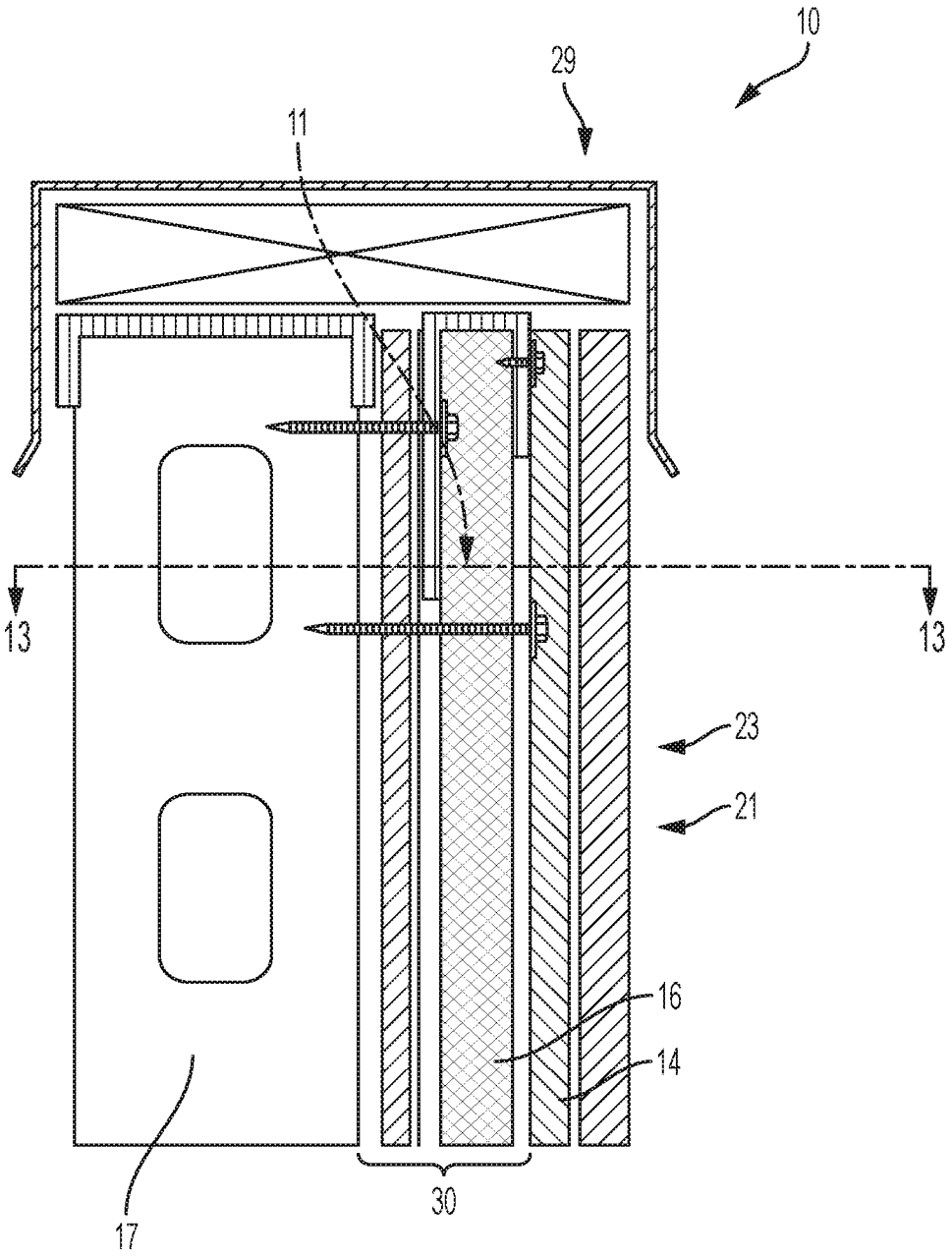
FIG. 12 is a view similar to FIG. 10 showing a large rail held in place by a top fixed connection.
Figure 13:
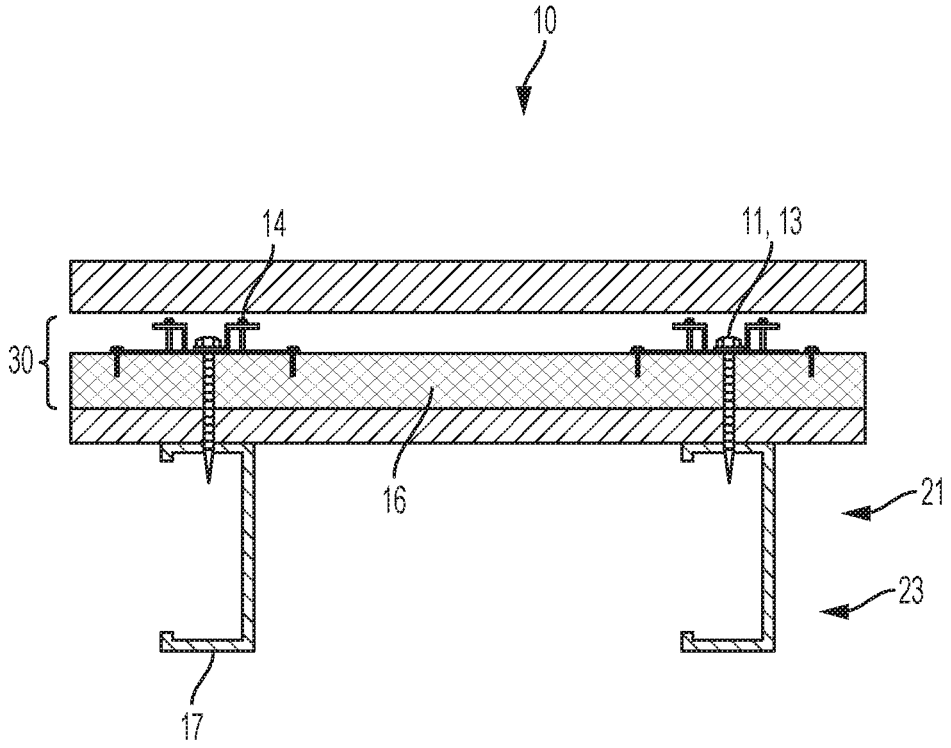
FIG. 13 is a cross sectional view taken along the line 13-13 of FIG. 12 showing the large rail within a building exterior.
Figure 14:
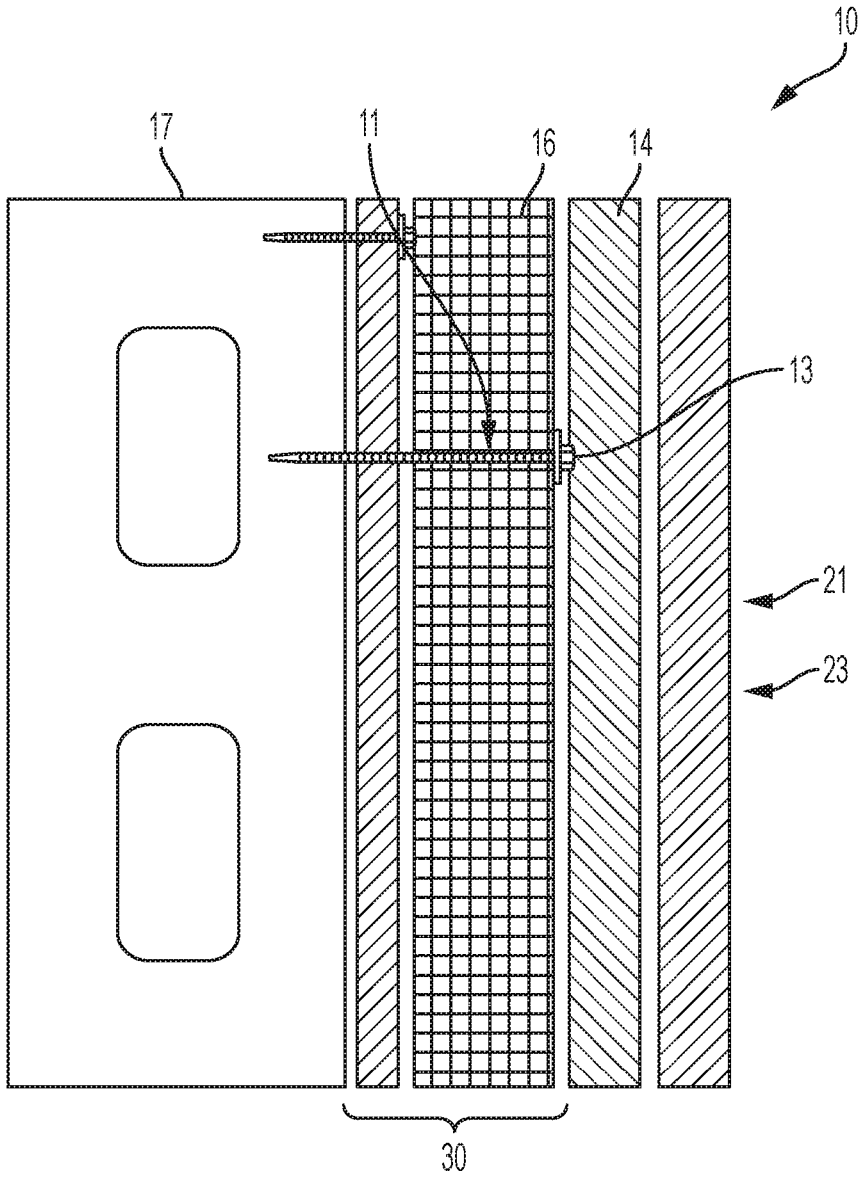
FIG. 14 is view similar to FIG. 10 showing a large rail with a building exterior.
Figure 15:
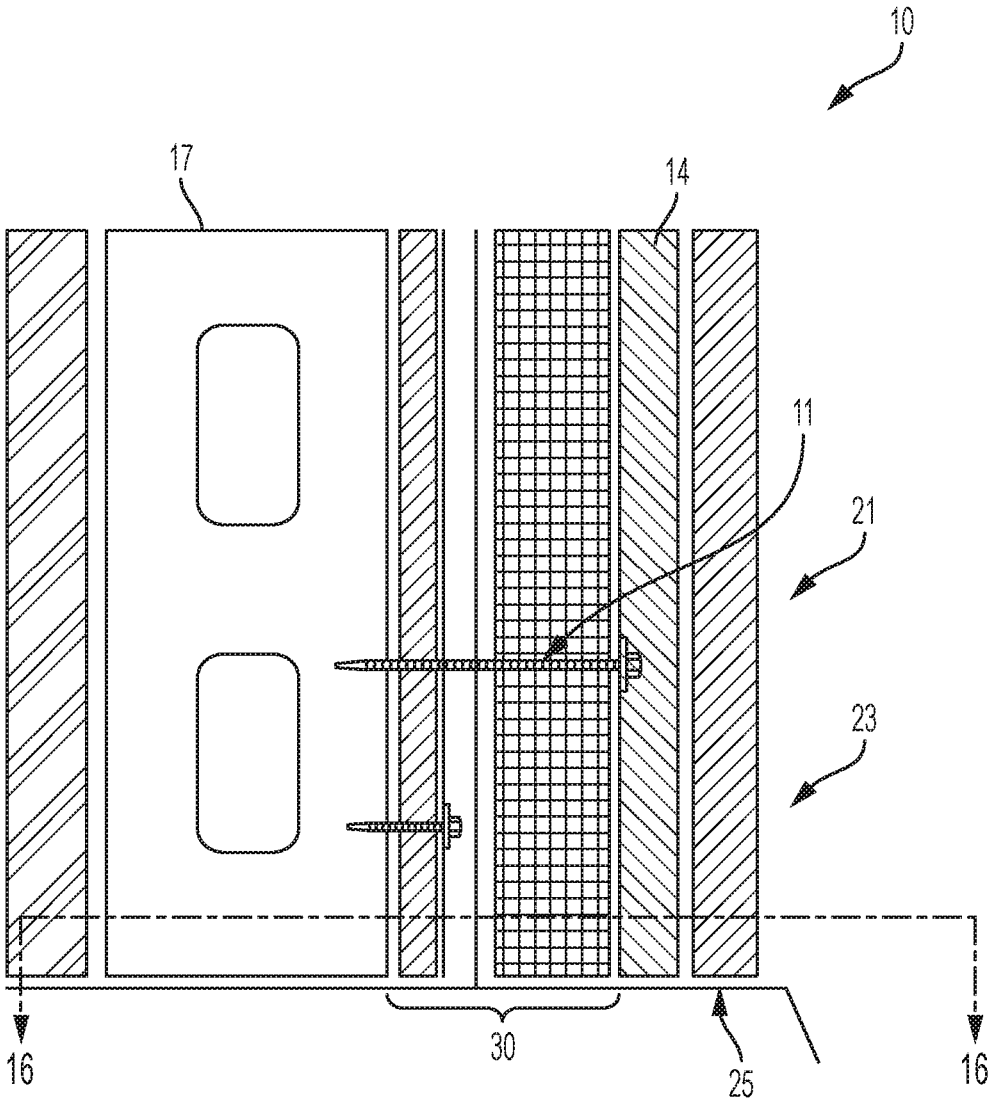
FIG. 15 is a view similar to FIG. 10 showing a large rail with a window head detail.
Figure 16:
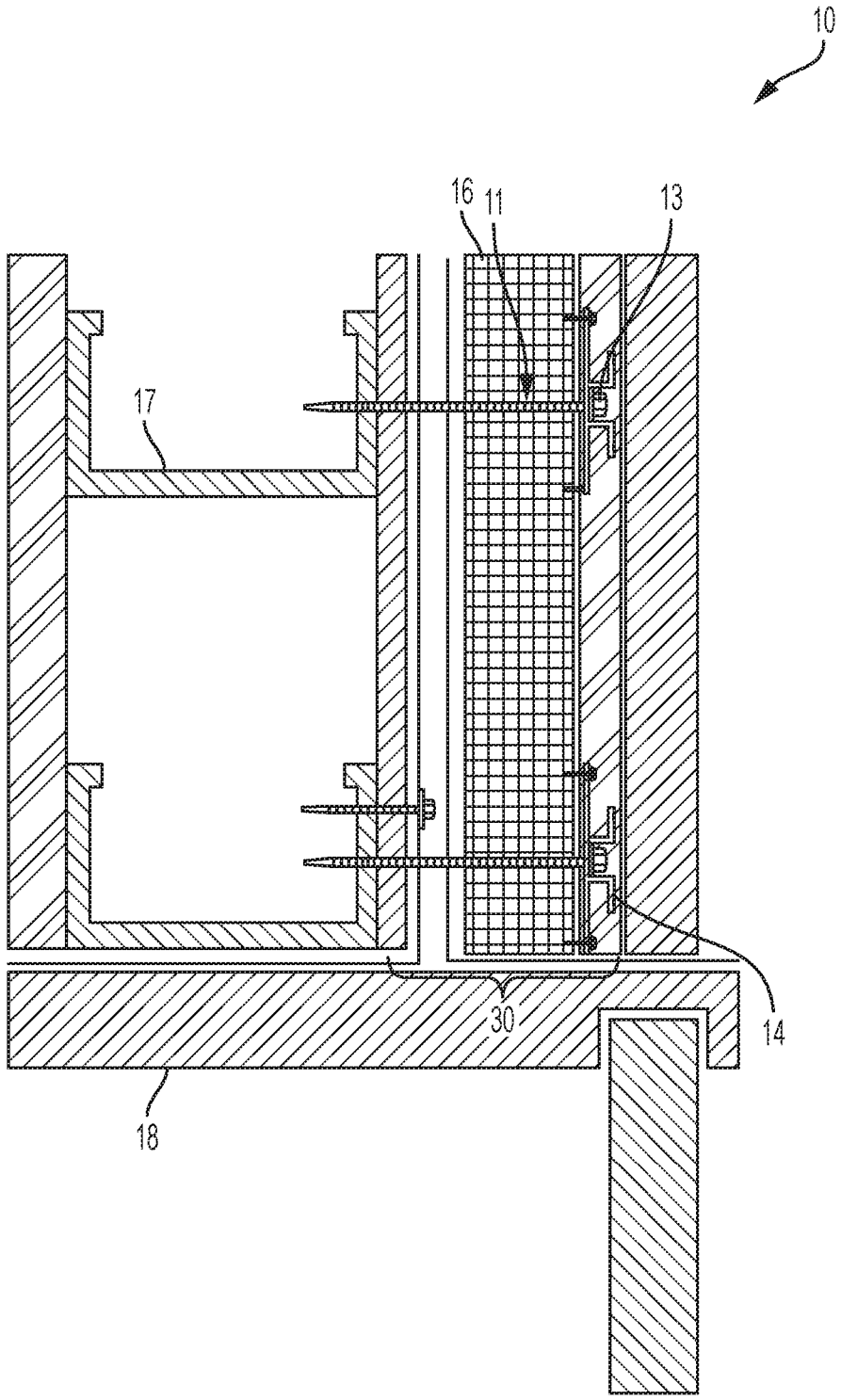
FIG. 16 is a cross sectional view taken along the line 16-16 of FIG. 15 showing a large rail with a window jam detail.

Referring to FIG. 12, large rail 14 may end at a top fixed connection with coping 29 above the top fixed connection. Referring to FIG. 14, large rail 14 may exist within wall 10 without proximity to a drip edge or top fixed connection. Referring to FIG. 15, in other embodiments, large rail 14 may end at window head 16. Referring to FIG. 16, in some embodiments, large rail 14 may be placed directly next to window frame 18.

As shown in FIG. 7, small rails 12 include two exterior channels 46 and one interior channel 47. When siding, such as façade panels 40, are attached to small rails 12, channels 46, 47 create gutters that direct water that penetrates through or around façade panels 40. Channels 46, 47 direct this water toward vertical rails 14. As shown in FIG. 8, vertical rails 14 include channels 48 that receive water from channels 46, 47 of small rails 12 when small rails are coupled to large rails 14. Channels 48 create downspouts that direct water toward drip edge 25 and eventually to the ground. Thus, small and vertical rails 12, 14 define a gutter and downspout system that directs water that gets behind the siding, such as façade panels 40, toward the ground so the captured water stays away from the portion of the building interior of rails 12, 14.

Figure 17:
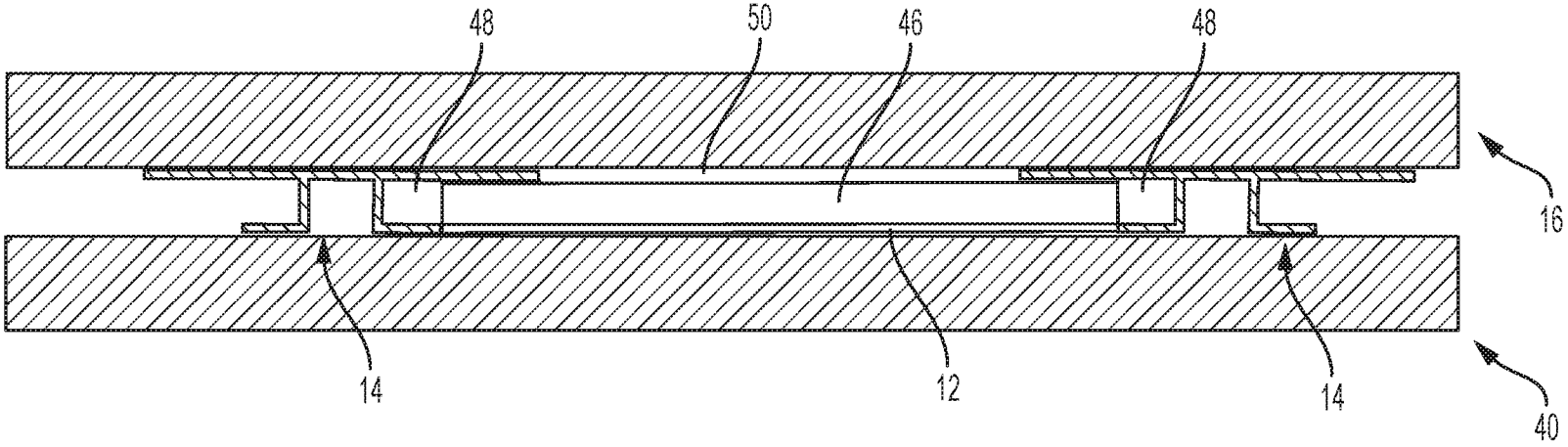
FIG. 17 is a top plan view of a pair of rails having a transverse rails positioned between the pair of vertical rails.

As shown in FIG. 17, two large rails 14 are coupled to insulation panel 16. Small rails 12 (for simplicity only one small rail 12 is shown) are coupled to large rails 14 and siding, such as a façade panel 40, is supported on small rail 12. As discussed above, water that gets behind panel 40 is captured by channels 46, 47 of small rail 12 and directed to channel 48 of either (or both) of larger rails 14 depending on the angle at which small rail 12 is installed on larger rails 14.

According to some installations, a gap 50 exists between insulation panel 16 and façade panel 40 creating a potential air flow path between large rails 14 having a cross-sectional area equal to a distance between insulation panel 16 and façade 40 and a distance between centers of large rails 14. For example, if the centers of large rails 14 are 16 inches apart and insulation panel 16 is about 0.7 inches (the height of vertical rails 14) away from façade 40, the cross-sectional area is about 11.2 square inches. Vertical rails 14 and transverse rails 12 fill a majority of this cross-sectional area to restrict the flow of air between insulation panel 16 and façade panel 40. According to some installations, at gap of about 1.15 square inches (0.1 inches wide and 11.5 inches long) exists between transverse rail 12 and installation panel 16. Channels 48 have an area of about 0.325 square inches (0.65 inches by 0.5 inches) each (or 0.65 square inches per vertical rail 14) and center channels 52 of vertical rails are about 0.45 square inches (0.74 inches by 0.6 inches). Thus, of the 11.2 square inches between insulation panel 16 and façade panel 40 mentioned above, about 2.25 square inches remains open after vertical and transverse rails 14, 12 are installed. Thus, about 20% of the cross-sectional area/air flow path remains open and about 80% is closed by vertical and transverse rails 14, 12. According to alternative embodiments of the present disclosure, more or less of the cross-sectional area/air flow path between insulation panel 16 (or whatever layer of material vertical rails 14 are attached to) and façade panel 40 (or whatever layer of material is supported on vertical and transverse rails 14, 12) is filled by rails 12, 14. For example, although 20% remains open as discussed above, 0%, 1%, 2%, 3%, 5%, 7%, 10%, 15%, 25%, 30%, 40%, 50%, etc. may remain open.

About 6% of the cross-sectional area/air flow path that remains open is provided by channels 48 of vertical rails 14 and permits water to flow down vertical rails 14 to drip edge 25 and eventually the ground as discussed above. According to alternative embodiments of the present disclosure, more or less of the cross-sectional area/air flow path between insulation panel 16 (or whatever layer of material vertical rails 14 are attached to) and façade panel 40 (or whatever layer of material is supported on vertical and transverse rails 14, 12) remains open because of channels 48 of vertical rails 14. For example, although 6% remains open because of channels 48 as discussed above, 0%, 1%, 2%, 3%, 5%, 7%, 10%, etc. may remain open because of channels 48 of rails 14.

For the purposes of this disclosure, the terms "vertical rails" and "small rails" may not necessarily refer to the geometric or physical characteristics of the rails. For example, in some embodiments, the vertical rails may have one or more dimensions, such as length, width, or height that are less than the one or more corresponding dimension of the small rails.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practices in the art to which this disclosure pertains.

What is claimed is:

1. A building system including:

a plurality of structural support members, a building wall layer including at least one or insulation, sheathing, and waterproofing, the building wall layer being coupled to the plurality of structural support members, a building rail system supported by the plurality of structural support members, including a plurality of rails positioned adjacent to the building wall layer including a plurality of substantially vertical rails and a plurality of transverse rails having a height extending between the substantially vertical rails and a thickness, and siding supported by the plurality of rails, the siding and the building wall layer cooperating to define a vertical air flow path therebetween, at least 60 percent of the vertical air flow path being blocked by the thickness of the plurality of transverse rails, the vertical rails have a different outer cross-sectional profile than an outer cross-sectional profile of the transverse rails.

2. The building system of claim 1, wherein the plurality of rails are comprised of aluminum.

3. The building system of claim 1, wherein at least 70 percent of the vertical air flow path is blocked by the plurality of rails.

4. The building system of claim 3, wherein less than 98 percent of the vertical air flow path is blocked by the plurality of rails.

5. A building system including:

a plurality of structural support members, a building wall layer including at least one of insulation, sheathing, and waterproofing, the building wall layer being coupled to the plurality of structural support members, a building rail system supported by the plurality of structural support members, including a plurality of rails positioned adjacent to the building wall layer, and siding supported by the rails, the plurality of rails defining a plurality of vertical channels positioned to direct water between the building wall layer and the siding in a vertical direction and a plurality of transverse channels positioned to direct water to the vertical channels between the building wall layer and the siding in a transverse direction, wherein the plurality of rails include a plurality of vertical rails defining the vertical channels and a plurality of transverse rails supported by the plurality of vertical rails and defining the transverse channels, and each of the vertical rails includes a first vertical flange, a second vertical flange, and a first rail wall connecting the first and the second vertical flanges, the first vertical flange, the second vertical flange, and the first rail wall of the vertical rails cooperating to define concavities facing away from an interior of the building, ends of the plurality of transverse rails are located within the concavities of the vertical rails.

6. The building system of claim 5, further comprising a drip edge positioned below the plurality of rails, wherein the vertical channels are positioned external of an upper most portion of the drip edge.

7. The building system of claim 5, wherein the plurality of transverse channels cooperate with the plurality of vertical channels to define an obtuse angle.

8. The building system of claim 5, wherein the plurality of transverse rails are devoid of repetitive openings.

* * * * *